US010927522B2

(12) United States Patent
Hendron et al.

(10) Patent No.: US 10,927,522 B2
(45) Date of Patent: Feb. 23, 2021

(54) STRUCTURAL ASSEMBLY FOR A WORK MACHINE AND METHOD OF ASSEMBLING NODE AND STRUT STRUCTURE

(71) Applicant: DEERE & COMPANY, Moline, IL (US)

(72) Inventors: Scott S. Hendron, Dubuque, IA (US); Nathan F. Tortorella, Bettendorf, IA (US); Mohamad S. El-Zein, Bettendorf, IA (US); Hector Portillo, Monterrey (MX); Hema V. Guthy, Moline, IL (US); Sankaran Subramaniam, Bettendorf, IA (US); Kristine M. Johanning, Cedar Falls, IA (US); Kent A. Burkett, Dubuque, IA (US); Jamie M. Coates, Asbury, IA (US); Jesse J. Kueter, Bellevue, IA (US)

(73) Assignee: Deere & Company

( * ) Notice: Subject to any disclaimer, the term of this patent is extended or adjusted under 35 U.S.C. 154(b) by 99 days.

(21) Appl. No.: 16/418,101

(22) Filed: May 21, 2019

(65) Prior Publication Data

US 2020/0370270 A1 Nov. 26, 2020

(51) Int. Cl.
*E02F 3/38* (2006.01)

(52) U.S. Cl.
CPC ..... *E02F 3/38* (2013.01)

(58) Field of Classification Search
None
See application file for complete search history.

(56) References Cited

U.S. PATENT DOCUMENTS

| | | | | |
|---|---|---|---|---|
| 3,947,191 | A * | 3/1976 | Milner, Jr. | B66C 23/64 403/334 |
| 5,228,259 | A | 7/1993 | Haddad et al. | |
| 8,932,208 | B2 * | 1/2015 | Kendale | A61B 1/00096 600/176 |
| 8,939,383 | B2 | 1/2015 | Honermann et al. | |
| 8,991,029 | B2 | 3/2015 | Yelistratov et al. | |
| 9,969,439 | B2 | 5/2018 | Ehrlich et al. | |
| 10,000,238 | B2 * | 6/2018 | Buschjohann | B62D 21/08 |
| 10,183,706 | B2 * | 1/2019 | Miller | B62D 21/11 |
| 10,450,717 | B1 * | 10/2019 | Wagner | E02F 9/006 |
| 2004/0232686 | A1 | 11/2004 | Locke | |
| 2007/0129719 | A1 * | 6/2007 | Kendale | A61B 1/00101 606/41 |
| 2008/0187427 | A1 * | 8/2008 | Durney | B21D 5/00 414/722 |

(Continued)

*Primary Examiner* — Gerald McClain

(57) ABSTRACT

A structural assembly for a work machine and method of assembling a node and strut structure are provided. The assembly includes at least one strut extending along a longitudinal axis and having a first end portion and a second end portion opposite the first end portion. The assembly further includes node members. Each of the node members has a first node portion with a first node cavity. The first end portion of at least one strut is configured to engage the first node portion of one of the node members. The second end portion of at least one strut is configured to engage the first node portion of another node member. An adhesive bonds the first end portion and the second end portion of the strut to the node members at the first node cavity of each of the node members.

20 Claims, 8 Drawing Sheets

(56) References Cited

U.S. PATENT DOCUMENTS

| | | | | |
|---|---|---|---|---|
| 2015/0298739 | A1* | 10/2015 | Buschjohann | B62D 29/008 296/193.08 |
| 2016/0037764 | A1* | 2/2016 | DePriest | A01M 7/0071 248/70 |
| 2018/0208251 | A1* | 7/2018 | Miller | E04B 1/1906 |

* cited by examiner

STRUCTURAL ASSEMBLY FOR A WORK MACHINE AND METHOD OF ASSEMBLING NODE AND STRUT STRUCTURE

BACKGROUND

Work machines, such as those used in the agriculture, construction, forestry industries and elsewhere, may be utilized for lifting, moving, and/or otherwise handling materials. In one non-limiting example, a backhoe may include a bucket pivotally coupled by a boom arm to the vehicle chassis. One or more hydraulic cylinders may move the boom arm and/or the bucket relative to the vehicle chassis to perform intended operations. Further, a work vehicle may be required to traverse a work area or other area for intended operations. Designing the structural assemblies of work machines, such as the boom arm of a construction vehicle in the non-limiting example, involves various considerations including, for example, strength, durability, wear resistance, and the amount and type of material the structure is capable of lifting, moving, or otherwise handling. While strength of such structures for work machines may be a focus to handle the substantial volume and weight of the material being moved and handled, substantial energy is required to move and operate such structural assemblies due to the associated weight and inertia. Further, machining, welding, forming, and/or assembling the work machine structures requires extensive tooling, equipment, expense, and energy.

SUMMARY

Various aspects of examples of the present disclosure are set out in the claims.

According to an aspect of the present disclosure, a structural assembly for a work machine is provided. The assembly includes at least one strut extending along a longitudinal axis and having a first end portion and a second end portion opposite the first end portion, a plurality of node members, each of the plurality of node members having a first node portion with a first node cavity, the first end portion of the at least one strut being configured to engage the first node portion of one of the plurality of node members, and the second end portion of the at least one strut configured to engage the first node portion of another of the plurality of node members, and an adhesive bonding the first end portion and the second end portion of the at least one strut to the plurality of node members at the first node cavity of each of the plurality of node members.

According to an aspect of the present disclosure, a structural assembly for a work machine is provided. The assembly includes at least one strut extending along a longitudinal axis and having an end portion, the end portion including an outer surface, at least one node having a first node portion with a first node cavity and a second node portion with a second node cavity, the first node portion and the second node portion being configured to join around the end portion of the at least one strut, and an adhesive layer disposed between the outer surface of the end portion of the at least one strut and at least one of the first node cavity and the second node cavity.

According to an aspect of the present disclosure, a method of assembling a node and strut structure is provided. The node includes a first node portion and a second node portion. The method includes applying adhesive to at least one of a first node cavity of the first node portion and a second node cavity of the second node portion, positioning a longitudinal end portion of at least one strut in the first node cavity of the first node portion, and joining the second node portion to the first node portion such that the longitudinal end portion of the at least one strut is positioned in the second node cavity.

The above and other features will become apparent from the following description and accompanying drawings.

BRIEF DESCRIPTION OF THE DRAWINGS

The detailed description of the drawings refers to the accompanying figures in which.

Figure 7:
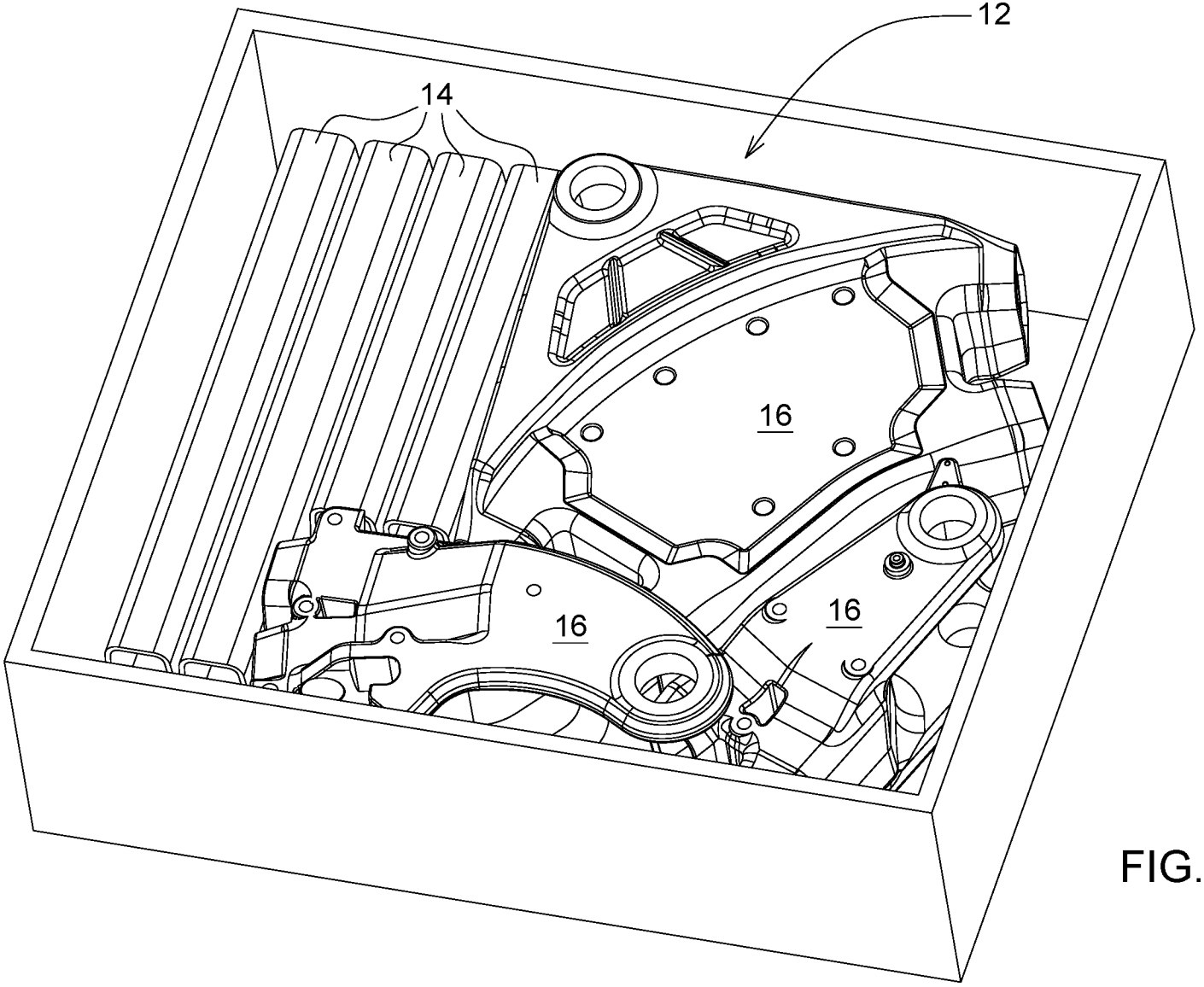
Figure 8:
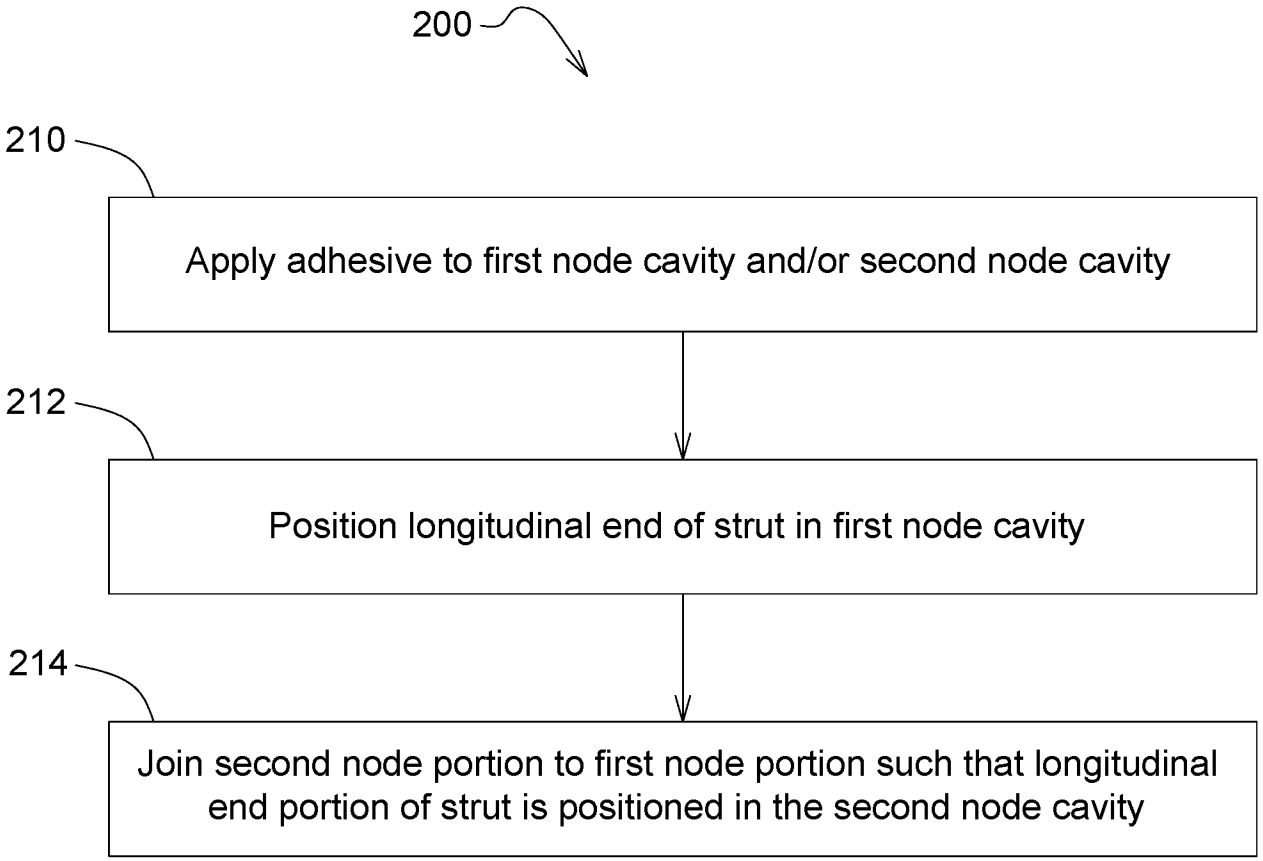

FIG. **6*a*** is a partial cross-view of a structural assembly in accordance with an embodiment of the present disclosure;

FIG. **6*b*** is a partial cross-view of a structural assembly in accordance with an embodiment of the present disclosure;

FIG. 7 illustrates a structural assembly in accordance with an embodiment of the present disclosure; and FIG. 8 illustrates a method of assembling a node and strut structure in accordance with an embodiment of the present disclosure.

Like reference numerals are used to indicate like elements throughout the several figures.

DETAILED DESCRIPTION

At least one example embodiment of the subject matter of this disclosure is understood by referring to FIGS. 1 through 8 of the drawings.

Figure 1:
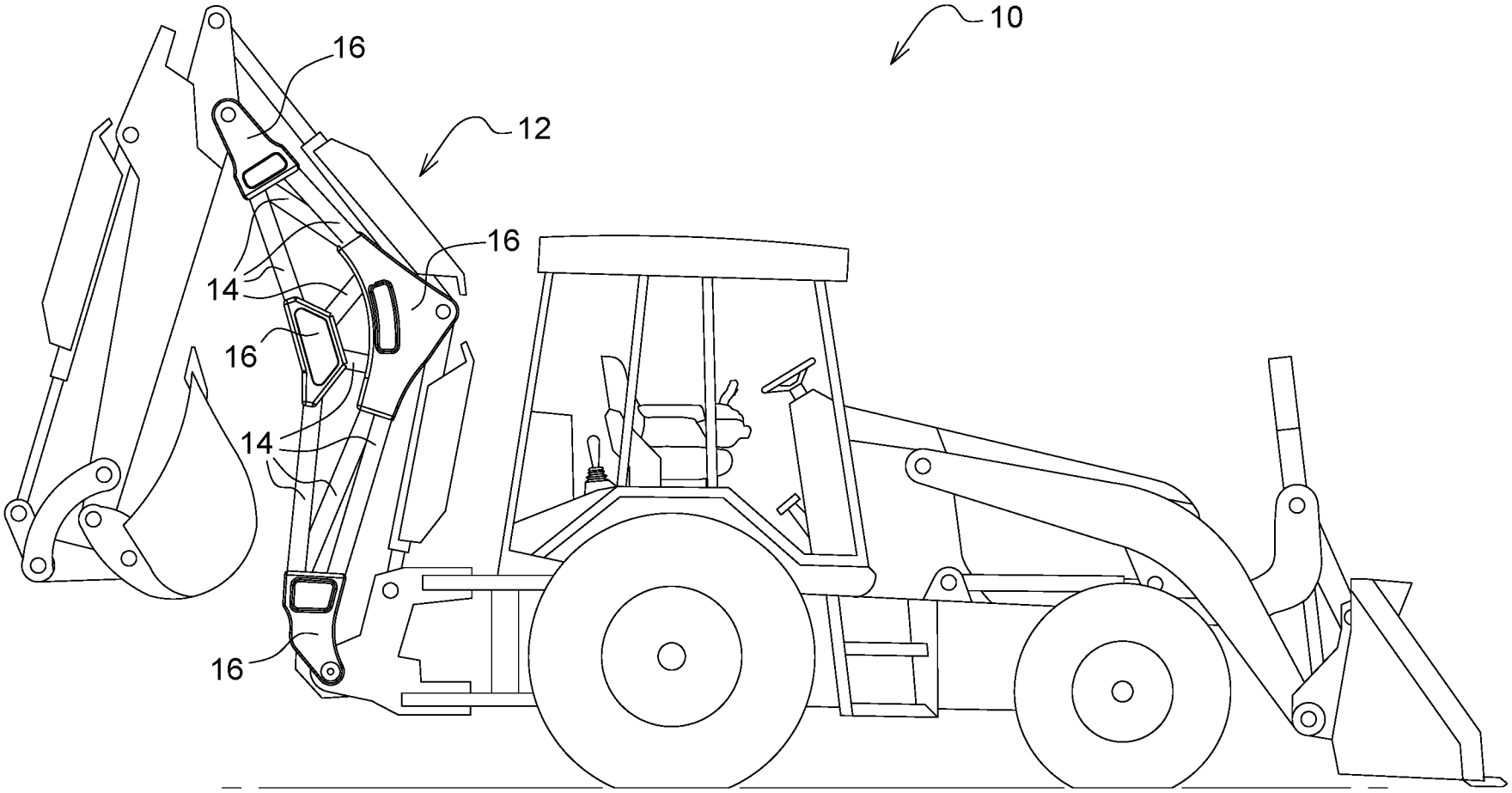
FIG. 1 illustrates a work machine in accordance with an embodiment of the present disclosure.

Referring now to FIG. 1, a work machine 10 having a structural assembly 12 is shown. The work machine 10 in the illustrated embodiment is a backhoe or other work vehicle configured for the construction industry. In additional embodiments not illustrated, the work machine 10 is a vehicle configured for the agriculture industry, the forestry industry, or other on or off-highway tasks or a stationary or fixed machine configured to perform work. In the embodiment illustrated in FIG. 1, the structural assembly 12 is a boom of a backhoe. In additional embodiments not illustrated, the structural assembly 12 performs as an arm, beam, support, or any other truss or space frame structure.

Figure 2:
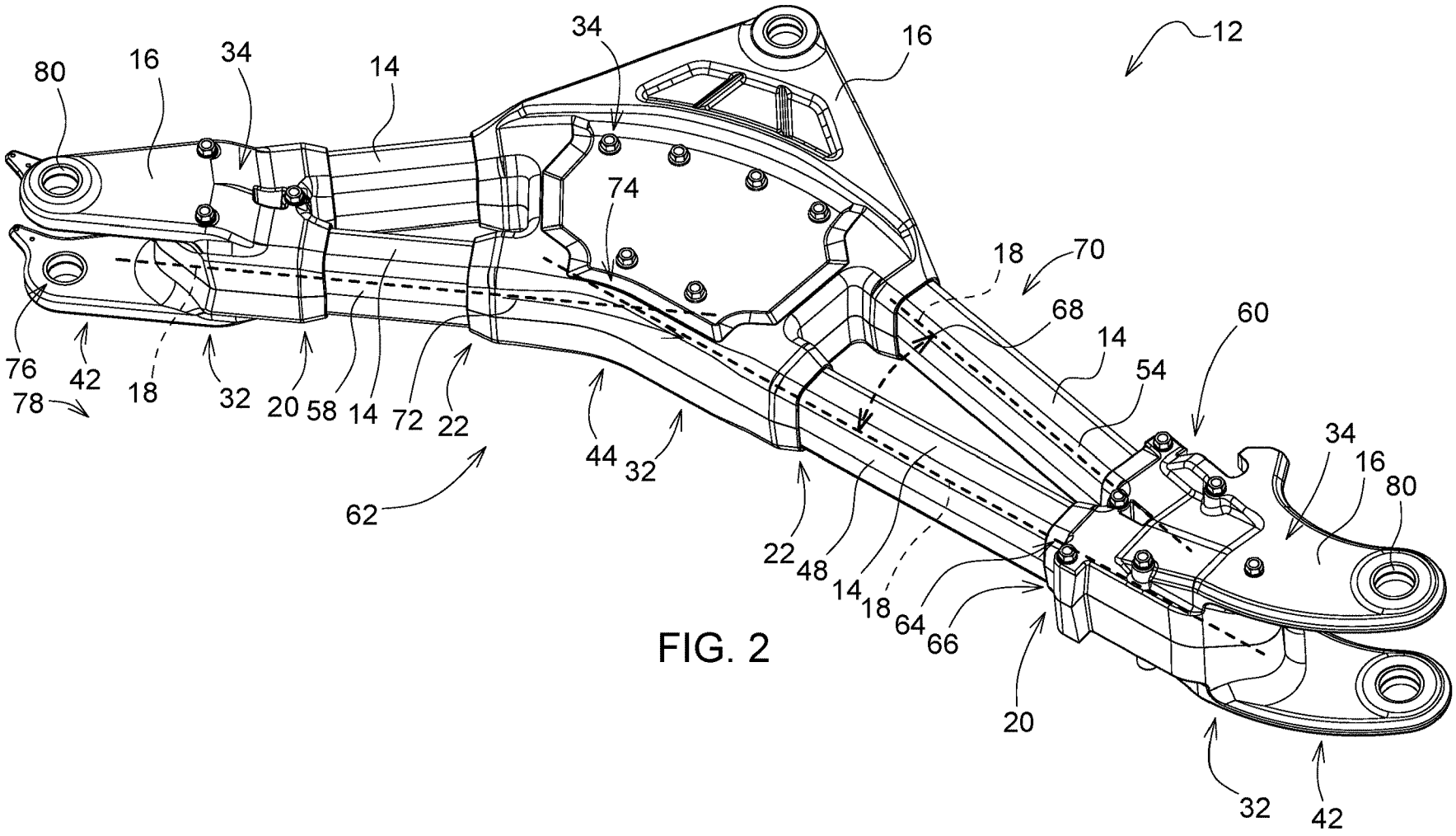
FIG. 2 illustrates a structural assembly in accordance with an embodiment of the present disclosure.
Figure 3:
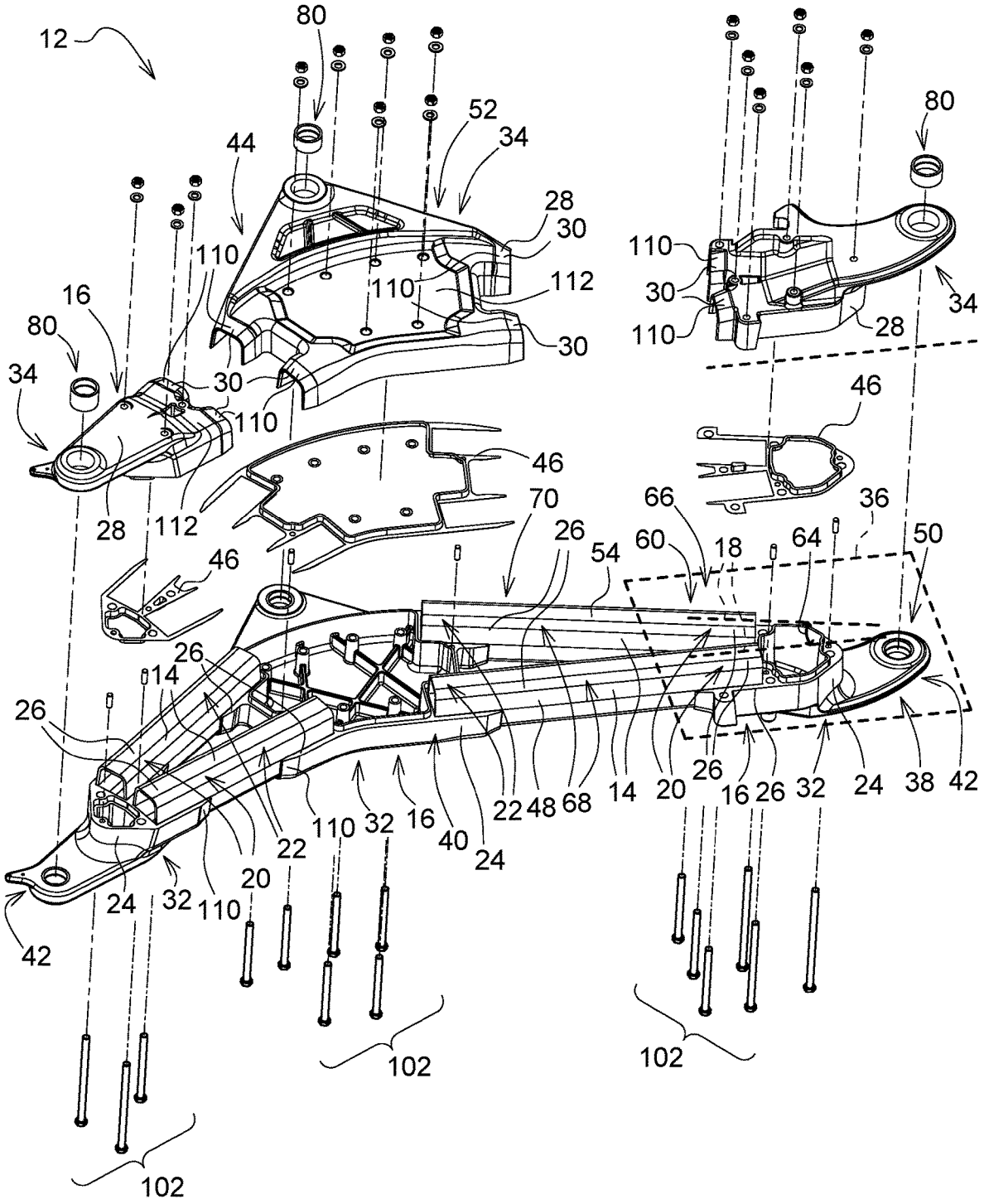
FIG. 3 is an exploded view of a structural assembly in accordance with an embodiment of the present disclosure.

As illustrated in FIG. 2, and further shown in exploded view in FIG. 3, the assembly 12 includes one or more struts 14 and one or more nodes or node members 16. Each strut 14 extends along a longitudinal axis 18 and includes a first end portion 20 and a second end portion 22 opposite the first end portion. Although the embodiments disclosed herein are straight, the strut(s) 14 described herein may be curved or may assume other geometries. Additionally, although the struts 14 are shown in the present embodiments as having a hexagonal or generally square tubular cross section, one or more of the strut(s) 14 may have a hollow or solid cross section of other shapes or geometries including, without limitation, square, hexagonal, octagonal, oval, or round tubular or I-beam geometries. In further embodiments not illustrated, one or more strut(s) 14 may extend multiple directions, thereby forming various strut geometries and configurations. The struts 14 of various embodiments may be composed of one or more metals, composites, polymers, ceramics, organic materials, or any combination thereof including, as non-limiting examples, aluminum or carbon fiber. The node members 16 of various embodiments may be composed of any one or more metals, composites, polymers, ceramics, organic materials, or any combination thereof, including, as non-limiting examples, magnesium or aluminum.

Referring now to FIG. 3, each of the node members 16 includes a first node portion 24 with a first node cavity 26. In the particular embodiment of FIG. 3, two or more first node cavities 26 for each node member 16 are shown. In the illustrated embodiment of FIG. 3, each of the node members 16 includes a second node portion 28 with a second node cavity 30. In the particular embodiment of FIG. 3, two or more second node cavities 30 for each node member 16 are shown. In embodiments not illustrated, one or more of the nodes 16 do not include the second node portion 28. In the illustrated embodiments, the first node portion 24 and the second node portion 28 are configured to engage each other. The first node portion 24 and the second node portion 28 are configured to respectively form or occupy a first side 32 of the node member 16 and a second side 34 of the node member 16 that is opposite the first side 32. In particular embodiments herein, the first node portion 24 and the first node cavity 26 may be referred to as a primary node portion with a primary node cavity, respectfully, and the second node portion 28 and the second node cavity 30 may be referred to as a secondary node portion with a secondary node cavity, respectfully. As illustrated in FIG. 3, the first node portion 24 joins, engages, couples or connects to, interfaces, assembles with, or otherwise meets the second node portion 28 generally along a joining plane 36. In the resulting assembly, the joining plane 36, in at least the embodiment illustrated in FIG. 3, is generally parallel to the longitudinal axis 18 of one or more of the struts 14 in the assembly 12. In an embodiment, the node portions 24, 28 interlock to form the node member 16. Although the present embodiments illustrate U-shaped node cavities 26, 30, in additional embodiments not illustrated, one or more of the node members 16 includes a cross-section that is L-shaped, resulting in complementary L-shaped cross-sectional node cavities 26, 30, or another cross-section to result in the node cavities 26, 30.

In the illustrated embodiment of FIG. 3, the first end portion 20 of one of the struts 14 is configured to engage the first node portion 24 of a first one 38 of the node members 16. The second end portion 22 of the strut 14 is configured to engage the first node portion 24 of a second one 40 of the node members 16. As illustrated in FIG. 3, the node members 16 of an embodiment include one or more terminating node members 42 and one or more joining node members 44. In an additional embodiment not shown, the assembly 12 does not include joining node members 44.

Figure 4:
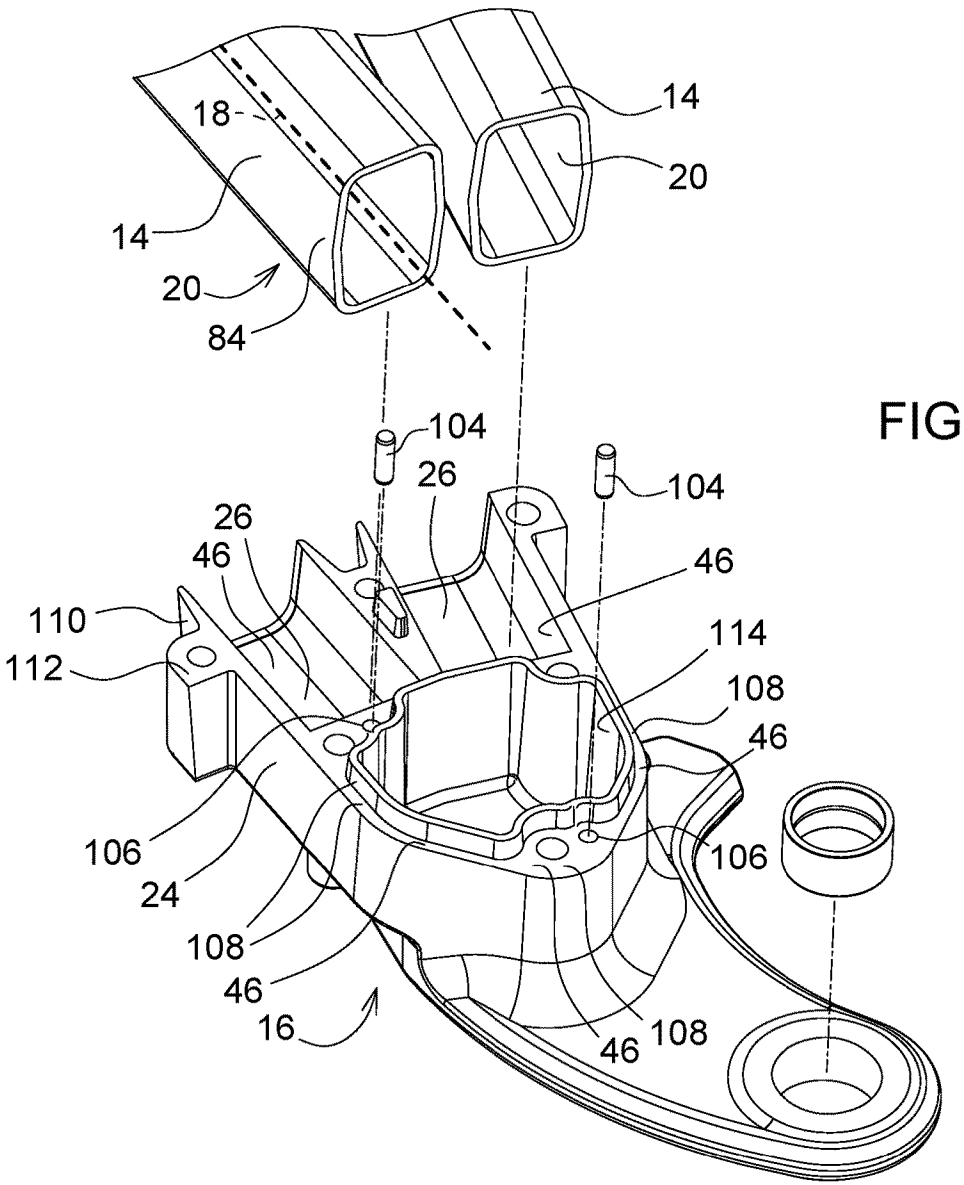
FIG. 4 illustrates a structural assembly in accordance with an embodiment of the present disclosure.
Figure 5:
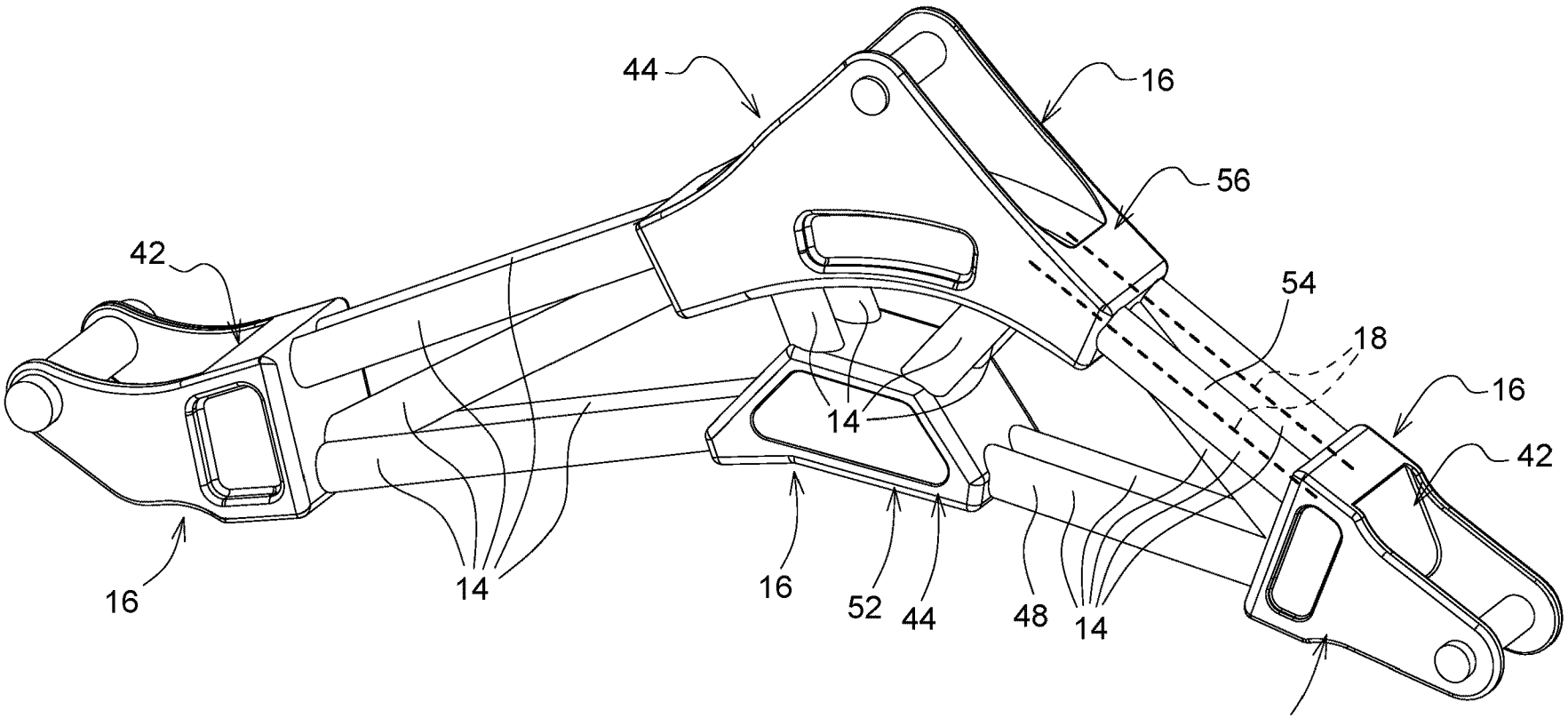
FIG. 5 illustrates a structural assembly in accordance with an embodiment of the present disclosure.

FIG. 5 illustrates a further embodiment of the assembly 12 of the present disclosure. The various embodiments of the assembly 12 contemplated by the present disclosure include any number of struts 14 and any number of nodes 16. As non-limiting examples, FIGS. 2-4 illustrate the assembly 12 having three nodes 16 and four struts 14, while the embodiment of FIG. 5 illustrates an assembly 12 having four nodes 16 and fourteen struts 14. The assembly 12 of FIG. 5 includes two joining node members 44 and two terminating node members 42. One of ordinary skill in the art, upon review and understanding of the present disclosure, will recognize the various node and strut amounts, orientations, positions, and configurations that are possible to form the assembly 12, and all such configurations are included as additional embodiments in the present disclosure.

In the embodiments illustrated in FIGS. 2 and 3, one or more of the terminating node members 42 includes at least one hole or bore 80 configured to form an end portion 82 of a boom of the work machine 10. In an additional embodiment, one or more joining node members 44 includes one or more holes or bores 80. The bore 80 may be utilized for attachment and/or operation of a work tool, actuator, or other structure, such as a bucket, secondary boom, or hydraulic cylinder to name non-limiting examples.

To further describe the interconnected structure of the assembly 12, in the illustrated embodiment shown in FIG. 3, each of the node members 16 includes the first node portion 24 having, for each strut 14 connected thereto, the first node cavity 26 and the second node portion 28 having, for each strut 14 connected thereto, the second node cavity 30. FIG. 4 illustrates two struts 14 and the first node portion 24 of one embodiment. Referring to FIG. 3, the first end portion 20 of a first strut 48 is configured to engage the first node portion 24 and the second node portion 28 of a first node member 50, and the second end portion 22 of the first strut 48 is configured to engage the first node portion 24 and the second node portion 28 of a second node member 52. Further, the first end portion 20 of a second strut 54 is configured to engage the first node portion 24 and the second node portion 28 of the first node member 50, and the second end portion 22 of the second strut 54 is configured to engage the first node portion 24 and the second node portion 28 of the second node member 52. However, in additional embodiments such as that illustrated in FIG. 5, the first strut 48 and the second strut 54 connect the first node member 50, the second node member 52, and a third node member 56. Such arrangements may be utilized and repeated to form additional portions of the assembly 12, and, as stated above, the various node and strut amounts, orientations, positions, and configurations of the assembly 12 are included as additional embodiments in the present disclosure.

As illustrated in FIGS. 2 and 3, the longitudinal axes 18 of the first strut 48 and the second strut 54 are configured to form a generally V-shaped assembly 60 of the first strut 48 and the second strut 54. The longitudinal axes 18 of the first strut 48 and the second strut 54 are further configured to form a first separation 64 at a first end 66 and a second separation 68 at a second end 70. The first separation 64 is greater than the second separation 68. Further, the longitudinal axes 18 of the first strut 48 and a third strut 58 are configured to form a generally V-shaped assembly 62 of the first strut 48 and the third strut 58. The longitudinal axes 18 of the first strut 48 and the third strut 58 are further configured to form a first separation 72 at a first end 74 and a second separation 76 at a second end 78. The first separation 72 is greater than the second separation 76. In one or more embodiments, such as the embodiment illustrated in FIG. 5, the longitudinal axes 18 of one or more struts 14 are substantially parallel to each other.

In one embodiment, one or more of the joining node members 44 connects two struts 14 to form an angle θ between the struts 14 of between 90 degrees and 180 degrees. One or more of the joining node members 44 connects two struts 14 to form an angle θ between the struts 14 of between 110 degrees and 170 degrees, in an additional embodiment, and an angle θ between the struts 14 of between 130 degrees and 160 degrees in an additional embodiment.

As shown in FIGS. 3 and 4, one or more of the node members 16, such as the joining node member(s) 44 and/or the terminating node member(s) 42, have a hollow central body 114 in the illustrated embodiment. In the illustrated embodiment of FIG. 3, one or more fasteners 102 secure, couple, or otherwise join the first node portion 24 to the second node portion 28. The fastener(s) 102 of the embodiment of FIG. 3 are spaced from the first node cavity 26 and the second node cavity 30 and do not extend through or contact the first node cavity 26 or the second node cavity 30. In additional embodiments not illustrated, one or more of the fastener(s) 102 are not spaced from the first node cavity 26 and/or the second node cavity 30 and may extend through or contact the first node cavity 26 and/or the second node cavity 30 for further coupling or reinforcement. In further embodiments not shown, other fastening structures or methods, welding, interference fitting, integral formation, and/or other joining methods may be utilized to form the assembly 12 described herein.

Referring again to the embodiment illustrated in FIGS. 2-4, an adhesive 46, such as in the form of an adhesive layer or coating, is utilized in the assembly 12 and is configured to bond the first end portion 20 and the second end portion 22 of the strut 14 to node members 16 at the first node cavity 26 and the second node cavity 30. The adhesive 46 may be acrylic, urethane, epoxy, or mixtures thereof, in one or more embodiments. In one non-limiting embodiment, the adhesive 46 has a shear strength between 20 MPa and 8 MPa with elongation at break above 40% at 23° C. In particular embodiments of the present disclosure, the adhesive 46 may cure at room temperature under ambient conditions or may be cured through other mechanisms, such as by heating. One non-limiting example of the adhesive 46 is the commercially available adhesive Plexus MA425, available from ITW Performance Polymers of Danvers, Mass.

With reference to FIG. 4, the end portions 20, 22 of each strut 14 include an outer surface 84. The outer surface 84 in the illustrated embodiments extends in a direction generally parallel to the longitudinal axis 18 of the strut 14. The first node portion 24 and the second node portion 28 of the node member 16 are configured to join around one of the end portions 20, 22 of each strut 14. In the illustrated embodiment, the first node cavity 26 and the second node cavity 30 of the node member 16 are configured to join around one of the end portions 20, 22 of each strut 14. The adhesive 46 is disposed between the outer surface 84 and the first node cavity 26 and, in at least one embodiment, the second node cavity 30. The adhesive 46 may be applied initially to one or both of the node cavities 26, 30 and/or any portion of the outer surface 84 of the strut 14.

Figure 6B:
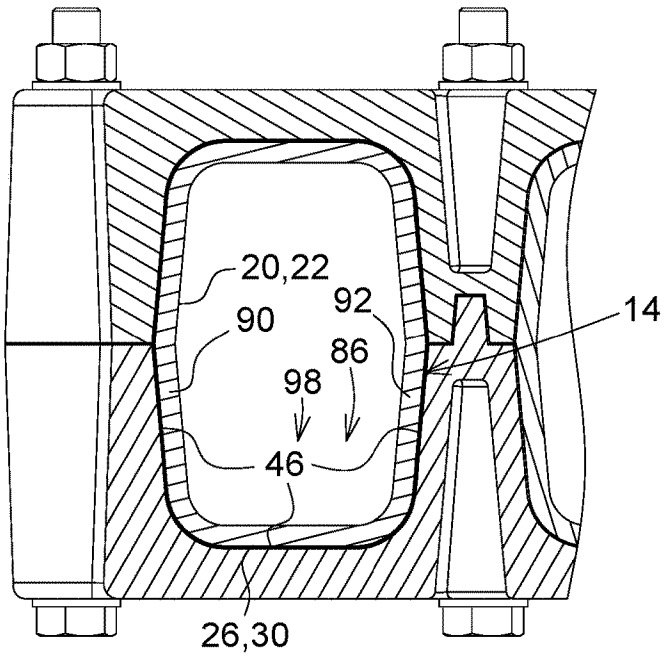
Figure 6A:
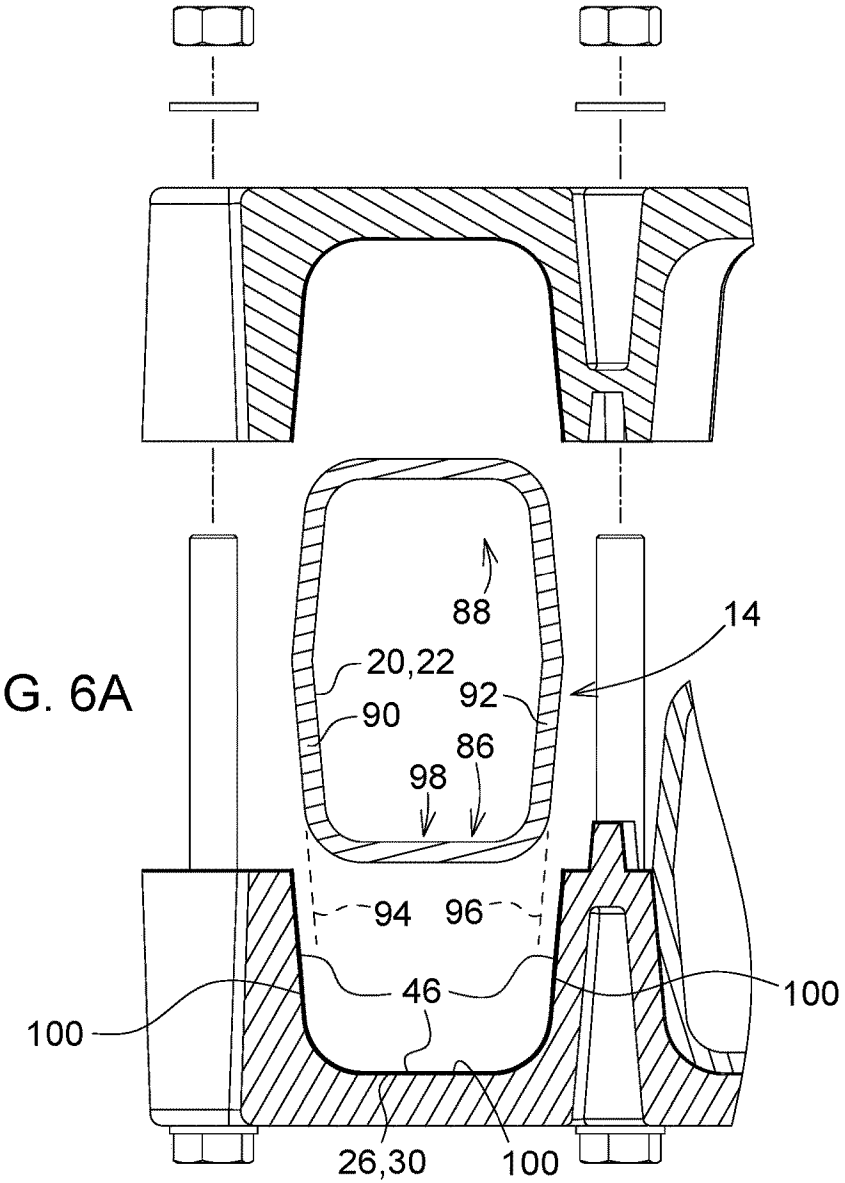

Referring now to the partial cross-sectional views of FIGS. 6*a* and 6*b*, and with continuing reference to FIG. 4, one or both of the end portions 20, 22 includes an end portion first side 86 and an end portion second side 88. One or both of the end portion first side 86 and the end portion second side 88 has opposing surfaces 90, 92 extending along non-parallel planes 94, 96 in the embodiment shown in FIG. 6*a*. In additional embodiments not illustrated, one or both of the end portion first side 86 and the end portion second side 88 may have opposing surfaces 90, 92 extending along parallel planes or substantially parallel planes. The outer surface 84 of one or both of the end portion first side 86 and the end portion second side 88 further includes an intermediate portion 98 disposed between the opposing surfaces 90, 92 that is at least partially flat. In additional embodiments not illustrated, the intermediate portion 98 is rounded or otherwise non-flat. As FIG. 6*a* illustrates, at least the first node cavity 26 includes cavity surfaces 100 that are generally complimentary, or respectfully parallel, corresponding, or otherwise geometrically equal, to the opposing surfaces 90, 92 of the end portion first side 86. Similarly, although not illustrated in FIG. 6*a*, the second node cavity 30 includes the cavity surfaces (not shown) that are generally complimentary, or respectfully parallel, corresponding, or otherwise geometrically equal, to the opposing surfaces (not shown) of the end portion second side 88.

FIG. 6*b* illustrates the strut 14 in a joined position with one of the node cavities 26, 30. The complimentary arrangement of the outer surface 84 of the strut 14 and the first and second node cavities 26, 30 permits consistent or substantially equal spacing between the outer surface 84 of the strut 14 and the first and second node cavities 26, 30 and, in at least one embodiment, a consistent or substantially equal thickness layer of adhesive 46 between the outer surface 84 of the strut 14 and the first and second node cavities 26, 30. Such an arrangement allows all portions of the outer surface 84 to simultaneously contact all portions of one of the first and second node cavities 26, 30, thereby reducing or preventing wiping or other undesirable movement or disturbance of the adhesive 46 from the surface of the strut 14 and/or the first and second node cavities 26, 30. With the adhesive 46 maintained as a consistent layer or otherwise remaining generally undisturbed through joining, the intended design strength and other intended properties and characteristics of the assembly 12 remains substantially unaffected, the quality of the assembly 12 is maintained, and/or the properties and behavior of the assembly 12 are predictable and consistent.

To further reduce or prevent wiping or other undesirable disturbance of the adhesive 46, the assembly 12 of an embodiment further includes one or more guiding members 104, such as a dowel rod to name a non-limiting example, disposed in one or both of the first node portion 24 and the second node portion 28, as referenced in FIG. 4. The guiding member(s) 104 are configured to guide the joining of the first node portion 24 to the second node portion 28. Specifically, one or both of the first node portion 24 and the second node portion 28 include guide holes 106 configured to receive the guiding member(s) 104 such that one or both of the first node portion 24 and the second node portion 28 follows a predetermined path for joining. The predetermined path in the illustrated embodiment is generally perpendicular to the longitudinal axis 18. Accordingly, the guiding member(s) 104 are configured to permit portions of one of the first and second node cavities 26, 30 to simultaneously contact the portions of the other of the first and second node cavities 26, 30 and the outer surface 84 of the strut 14, thereby reducing or preventing wiping or other undesirable movement or disturbance of the adhesive 46 from the surface of the strut 14 and/or the first and second node cavities 26, 30. The guiding members 104 of the illustrated embodiment remain with the assembly 14 following formation. In additional embodiments, the guiding members 104 are removed following formation of the assembly 12, such as part of a fixture or assembly jig.

Referring again to FIG. 4, one or both of the first node portion 24 and the second node portion 28 includes one or more joining surface(s) 108 spaced from the first node cavity 26 and the second node cavity 30. The joining surface(s) 108 has disposed thereon, in an embodiment, a layer or other arrangement of adhesive 46 that is contiguous with the adhesive 46 used to adhere the strut 14 to one or both of the first node portion 24 and the second node portion 28. In another embodiment, the adhesive 46 disposed on the joining surface 108 is not contiguous with the adhesive 46 used to adhere the strut 14 to one or both of the first node portion 24 and the second node portion 28. Further, one, some, or all of the joining surfaces 108 extends in a direction of assembly that is not parallel to the direction of assembly in order to avoid wiping or other disturbance of the adhesive 46 disposed thereon, similar to the surfaces of the cavities 26, 30, as described above. The joining surfaces 108 of an embodiment are configured to provide maximum adhesive surface area, such as by providing surface area along multiple planes in one non-limiting exemplary embodiment, thereby increasing strength of the joint between the first node portion 24 and the second node portion 28.

Further shown in FIGS. 3 and 4, one or more of the nodes 16 includes one or more tapered interface portion(s) 110 as part of an outer surface 112 of the node 16 at the interface between the strut 14 and the outer surface 112 of the node 16. The tapered interface portion 110 is characterized by a reducing thickness such that a thickness of the interface portion 110 proximal to the strut 14 is less than a thickness distal to the strut 14. The tapered interface portion(s) 110 prevents or reduces stress concentration at such locations of the node 16 near the strut 14.

Referring now to FIG. 8, a method 200 of assembling the node and strut structural assembly 12 is provided. The method 200 includes applying, at step 210, the adhesive 46 to the first node cavity 26 of the first node portion 24 and the second node cavity 30 of the second node portion 28. The method 200 further includes positioning, at step 212, one of the longitudinal end portions 20, 22 of the strut 14 in the first node cavity 26 of the first node portion 24. The method 200 further includes joining, at step 214, the second node portion 28 to the first node portion 24 such that the longitudinal end portion 20, 22 of the strut 14 is positioned in the second node cavity 30.

The method 200 of additional embodiments further includes guiding one or both of the first node portion 24 and the second node portion 28 toward joining with the other with the guiding member(s) 104 and joining the first node portion 24 to the second node portion 28. The method 200 of additional embodiments further includes fastening, welding, or otherwise joining the first node portion 24 and the second node portion 28 together, such as with fasteners or another secondary joining method or structure. The method 200 of additional embodiments further includes applying the adhesive 46 to the first node cavity 26 and the second node cavity 30 and, in additional embodiments, applying the adhesive 46 to the joining surface(s) 108 and/or another surface of the central body 114 of the node member 16. The method 200 may further include roughing one or more surfaces of the node cavities 26, 30 before applying the adhesive 46 to the first node cavity 26 of the first node portion 24 and/or the second node cavity 30 of the second node portion 28.

As illustrated in FIG. 7, the assembly 12 and the method 200 described herein further allows efficient and inexpensive shipping and handling of the assembly 12, such as by flat-packing shipping methods. As shown, the struts 14, nodes 16, and any additional hardware or portions of the assembly 12 may be sized and oriented for high density, low volume packaging and transported for assembly without substantial labor or equipment.

Without in any way limiting the scope, interpretation, or application of the claims appearing below, it will be appreciated that the assembly 12 and/or the method 200 of the embodiments of the present disclosure provide a lightweight structural assembly 12 for a work machine to increase lifting capacity due to reduced weight of the assembly 12, increase acceleration of the work machine and its work tools, and reduce fuel and energy consumption with increased work efficiency. Further, in the case of a vehicular work machine, the assembly 12 and method 200 provides improved ride characteristics and handling of the vehicle due to reduced inertia from the assembly 12. Additionally, visibility, for example of a work area, is improved with the assembly 12 due to the ability to at least partially see through the assembly 12 of various embodiments. The various adhering, fastening, and joining arrangements for the assembly 12 and the various and diverse structural arrangements described herein allow formation of the assembly 12 according to flexible manufacturing methods and with resulting structure that may be tailored to a particular larger structure, application, environment, and/or requirement. Further, utilizing the adhesive 46 to join the various portions of the assembly 12, rather than welding and other methods, simplifies tooling to form the assembly 12 and avoids distortion or other undesirable results of the structure such that holes and/or other features of the assembly 12 may be machined or otherwise included before joining portions to form the assembly 12.

As used herein, "e.g." is utilized to non-exhaustively list examples, and carries the same meaning as alternative illustrative phrases such as "including," "including, but not limited to," and "including without limitation." As used herein, unless otherwise limited or modified, lists with elements that are separated by conjunctive terms (e.g., "and") and that are also preceded by the phrase "one or more of," "at least one of," "at least," or a like phrase, indicate configurations or arrangements that potentially include individual elements of the list, or any combination thereof. For example, "at least one of A, B, and C" and "one or more of A, B, and C" each indicate the possibility of only A, only B, only C, or any combination of two or more of A, B, and C (A and B; A and C; B and C; or A, B, and C). As used herein, the singular forms "a", "an" and "the" are intended to include the plural forms as well, unless the context clearly indicates otherwise. Further, "comprises," "includes," and like phrases are intended to specify the presence of stated features, steps, operations, elements, and/or components, but do not preclude the presence or addition of one or more other features, steps, operations, elements, components, and/or groups thereof.

While the present disclosure has been illustrated and described in detail in the drawings and foregoing description, such illustration and description is not restrictive in character, it being understood that illustrative embodiment (s) have been shown and described and that all changes and modifications that come within the spirit of the present disclosure are desired to be protected. Alternative embodiments of the present disclosure may not include all of the features described yet still benefit from at least some of the advantages of such features. Those of ordinary skill in the art may devise their own implementations that incorporate one or more of the features of the present disclosure and fall within the spirit and scope of the appended claims.

What is claimed is:

1. A structural assembly for a work machine, the assembly comprising:

at least one strut extending along a longitudinal axis and having a first end portion and a second end portion opposite the first end portion;

a plurality of node members, each of the plurality of node members having a first node portion with a first node cavity, the first end portion of the at least one strut being configured to engage the first node portion of one of the plurality of node members, and the second end portion of the at least one strut configured to engage the first node portion of another of the plurality of node members; and an adhesive bonding the first end portion and the second end portion of the at least one strut to the plurality of node members at the first node cavity of each of the plurality of node members;

wherein each of the plurality of node members further comprises a second node portion with a second node cavity, the first end portion of the first strut being configured to engage the second node portion of the one of the plurality of node members;

wherein the first node portion and the second node portion of the one of the plurality of node members are configured to surround the first end portion of the at least one strut; and wherein the work machine is a work vehicle.

2. The assembly of claim 1, wherein the at least one strut comprises a first strut and a second strut, each of the plurality of node members further having a second node portion with a second node cavity, the first end portion of the first strut being configured to engage the second node portion of the one of the plurality of node members, and the second end portion of the first strut configured to engage the second node portion of the other of the plurality of node members.

3. The assembly of claim 2, wherein the longitudinal axes of each of the first strut and the second strut are configured to form a generally V-shaped assembly of the first strut and the second strut.

4. The assembly of claim 2, wherein the longitudinal axes of the first strut and second strut are configured to form a first separation at a first end and a second separation at a second end, wherein the first separation is greater than the second separation.

5. The assembly of claim 1, wherein:

the at least one strut comprises a plurality of struts, each of the plurality of struts extending along a longitudinal axis and having a first end portion and a second end portion opposite the first end portion;

the plurality of node members comprises a plurality of terminating node members and at least one joining node member;

the plurality of terminating node members comprising a first terminating node member and a second terminating node member;

each of the first terminating node member and the second terminating node member having a first node portion with a first node cavity;

the first end portion of a first one of the plurality of struts is configured to engage the first node portion of the first terminating node member;

the first end portion of a second one of the plurality of struts is configured to engage the first node portion of the second terminating node member;

the at least one joining node member includes a primary node portion with a primary node cavity and a secondary node portion with a secondary node cavity, the primary node portion being opposite the secondary node portion;

the second end portion of each of the first one and the second one of the plurality of struts is configured to engage the primary node portion and the secondary node portion of the at least one joining node member; and the adhesive bonds the first end portion of the first one of the plurality of struts to the first terminating node member, the first end portion of the second one of the plurality of struts to the second terminating node member, and the second end portion of each of the first one and the second one of the plurality of struts to the at least one joining node member.

6. The assembly of claim 5, wherein at least one of the plurality of terminating node members comprises a bore configured to form an end portion of a boom of the work machine.

7. The assembly of claim 5, wherein the at least one joining node member connects the first one of the plurality of struts and the second one of the plurality of struts to form an angle between the first one of the plurality of struts and the second one of the plurality of struts of between 90 degrees and 175 degrees.

8. The assembly of claim 5, wherein:

the plurality of struts further includes a third one of the plurality of struts and a fourth one of the plurality of struts;

the first end portion of the third one of the plurality of struts is configured to engage the first node portion of the first terminating node member;

the first end portion of the fourth one of the plurality of struts is configured to engage the first node portion of the second terminating node member;

the second end portion of each of the third one and the fourth one of the plurality of struts is configured to engage the primary node portion and the secondary node portion of the at least one joining node member; and the adhesive bonds the first end portion of the third one of the plurality of struts to the first terminating node member, the first end portion of the fourth one of the plurality of struts to the second terminating node member, and the second end portion of each of the third one and the fourth one of the plurality of struts to the at least one joining node member.

9. A structural assembly for a work machine, the assembly comprising:

at least one strut extending along a longitudinal axis and having an end portion, the end portion including an outer surface;

at least one node having a first node portion with a first node cavity and a second node portion with a second node cavity, the first node portion and the second node portion being configured to join around the end portion of the at least one strut wherein the first node portion and the second node portion of the at least one node surround the end portion of the at least one strut; and an adhesive layer disposed between the outer surface of the end portion of the at least one strut and at least one of the first node cavity and the second node cavity; and wherein the work machine is a work vehicle.

10. The assembly of claim 9, wherein the end portion includes an end portion first side and an end portion second side, at least one of the end portion first side and the end portion second side having a plurality of opposing surfaces extending along non-parallel planes.

11. The assembly of claim 10, wherein at least one of the first node cavity and the second node cavity comprises a plurality of cavity surfaces complimentary to the plurality of opposing surfaces of the at least one of the end portion first side and the end portion second side.

12. The assembly of claim 9, further comprising at least one fastener joining the first node portion to the second node portion and being spaced from the first node cavity and the second node cavity.

13. The assembly of claim 9, further comprising at least one guiding member disposed in at least one of the first node portion and the second node portion and configured to guide the joining of the first node portion to the second node portion.

14. The assembly of claim 9, wherein at least one of the first node portion and the second node portion comprises at least one joining surface spaced from the first node cavity and the second node cavity, the adhesive layer further disposed on the at least one joining surface.

15. The assembly of claim 9, wherein the at least one node includes at least one tapered interface portion at an interface between the at least one strut at an outer surface of the at least one node.

16. A method of assembling a node and strut structure, the node including a first node portion and a second node portion, the method comprising:

applying adhesive to at least one of a first node cavity of the first node portion and a second node cavity of the second node portion;

positioning a longitudinal end portion of at least one strut in the first node cavity of the first node portion; and joining the second node portion to the first node portion such that the longitudinal end portion of the at least one strut is positioned in the second node cavity;

wherein joining the second node portion to the first node portion results in the first node portion and the second node portion of the node surrounding the longitudinal end portion of the at least one strut; and wherein the node and strut structure is configured to form a portion of a work vehicle.

17. The method of claim 16, further comprising:

guiding the first node portion and the second node portion toward joining with the at least one guiding member; and joining the first node portion to the second node portion.

18. The method of claim 16, further comprising fastening the first node portion and the second node portion together.

19. The method of claim 16, wherein applying the adhesive comprises applying the adhesive to the first node cavity and the second node cavity.

20. The method of claim 16, further comprising roughing at least one of a plurality of cavity surfaces of the at least one of the first node cavity and the second node cavity before applying the adhesive to the at least one of the first node cavity of the first node portion and the second node cavity of the second node portion.

* * * * *